US008186000B2

(12) United States Patent
Hettes

(10) Patent No.: US 8,186,000 B2
(45) Date of Patent: May 29, 2012

(54) END BRUSH WITH REDUCED BRISTLE FLARE

(75) Inventor: Frank J. Hettes, Greentown, PA (US)

(73) Assignee: Weiler Corporation, Cresco, PA (US)

( * ) Notice: Subject to any disclaimer, the term of this patent is extended or adjusted under 35 U.S.C. 154(b) by 1157 days.

(21) Appl. No.: 11/439,560

(22) Filed: May 23, 2006

(65) Prior Publication Data

US 2007/0271718 A1 Nov. 29, 2007

(51) Int. Cl.
*A46B 13/00* (2006.01)
*A46D 1/00* (2006.01)

(52) U.S. Cl. ..... 15/179; 15/207.2

(58) Field of Classification Search ..... 15/179, 15/180, 207.2, 198; 451/540–588
See application file for complete search history.

(56) References Cited

U.S. PATENT DOCUMENTS

| | | | | | |
|---|---|---|---|---|---|
| 960,216 | A * | 5/1910 | Dixon | 15/204 |
| 1,497,921 | A * | 6/1924 | Levedahl | 15/198 |
| 1,652,834 | A * | 12/1927 | Neufeld | 15/179 |
| 1,847,496 | A * | 3/1932 | Priest | 132/290 |
| 2,062,047 | A * | 11/1936 | Bickel et al. | 15/180 |
| 3,335,444 | A * | 8/1967 | Weiler | 15/179 |
| 3,382,521 | A * | 5/1968 | Holder et al. | 15/198 |
| 4,462,136 | A * | 7/1984 | Nakao et al. | 15/167.1 |
| 6,210,064 | B1 * | 4/2001 | White et al. | 401/279 |
| 6,224,287 | B1 * | 5/2001 | Gieux | 401/282 |

* cited by examiner

*Primary Examiner* — Bryan R Muller
(74) *Attorney, Agent, or Firm* — Drinker, Biddle & Reath, LLP

(57) ABSTRACT

An end brush is disclosed. In an illustrative implementation, a plurality of bristles are each fastened at a fixed end to a body. The bristles include a plurality of inner bristles proximal to a rotational axis of the body, and a plurality of outer bristles distal to the rotational axis. The inner bristles have a substantially uniform length. The outer bristles are cut at lengths shorter than the inner bristle length, and at an angle to the rotational axis.

5 Claims, 4 Drawing Sheets

END BRUSH WITH REDUCED BRISTLE FLARE

BACKGROUND OF THE INVENTION

Rotatable brushes known as end brushes have been developed for cleaning, finishing, and polishing surfaces. For example, an end brush may be applied to a surface of a work piece, and used to remove rust, paint, markings, scale, slag, carbonization, or dirt from the surface. End brushes are generally attachable to tools that are able to impart high-speed rotation. For example, stem-mounted end brushes have been designed to be chucked into a power drill.

A typical end brush includes bristles configured to be pressed against the surface of the work piece. Bristles can be formed from crimped or straight wire, nylon, polypropylene, and other suitably stiff materials.

A problem with conventional end brushes is that the bristles flare outwardly when the brush is chucked into or otherwise attached to a rotary tool and spun at high speeds. When the brush is brought into contact with the work piece, the brush generally has to be pushed against the work piece to overcome the flare and keep the bristles in contact with the surface. This can be a particular problem with inside corners or recessed areas of a work piece. Pushing the bristles into the work piece, against the flare, can cause the bristles to bend and break prematurely.

SUMMARY OF THE INVENTION

An end brush has a plurality of bristles, each fastened at a fixed end to a body. The bristles include a plurality of inner bristles proximal to a rotational axis of the body, and a plurality of outer bristles distal to the rotational axis. The inner bristles have a substantially uniform inner bristle length. The outer bristles are cut at lengths shorter than the inner bristles, and at an angle to the rotational axis.

It is to be understood that both the foregoing general description and the following detailed description are exemplary and explanatory and are intended to provide further explanation of the invention as claimed.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Aspects of the present invention provide an end brush having bristles shaped to reduce or eliminate flare. In an illustrative embodiment, when the end brush is spun there is little or no bristle flare, and it is easy to get the bristles into inside corners of a work piece.

Figure 1A:
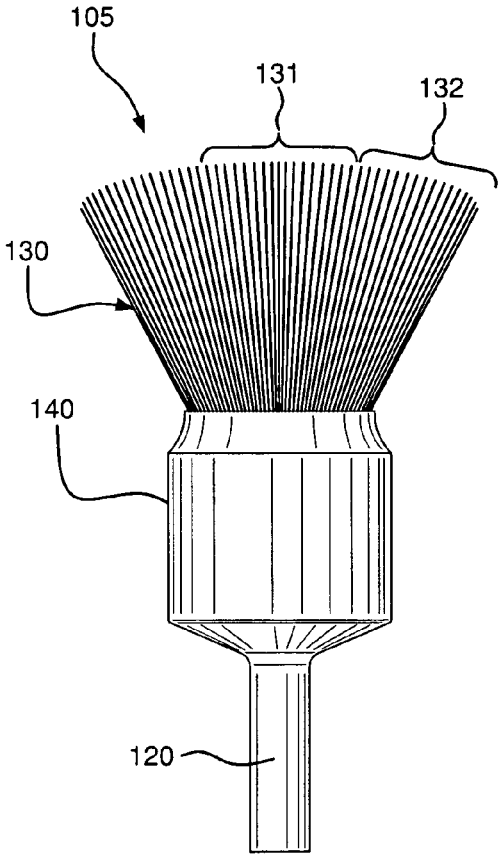
FIG. 1A (Prior Art)
FIG. 1A is a side view of a conventional end brush of the prior art.
Figure 1B:
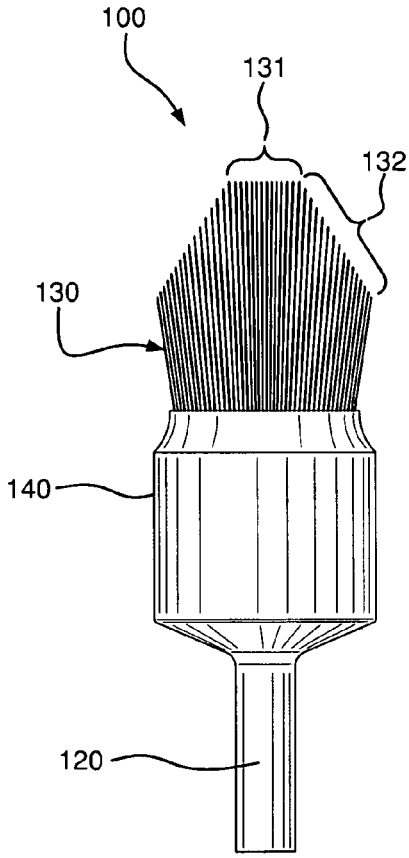
FIG. 1B is a side view of an exemplary end brush in accordance with an embodiment of the invention.

Referring to the drawings, in which like reference numerals indicate like elements, FIG. 1A is a photograph of a side view of a conventional end brush 105 of the prior art, and FIG. 1B is a photograph of a side view of an exemplary end brush 100 in accordance with an embodiment of the invention.

End brush 100, 105 has a stem 120 configured to permit the end brush 100, 105 to be coupled to any of various tools for imparting high-speed rotation around a center axis of stem 120. In an illustrative example, stem 120 includes generally cylindrical portion designed to be chucked or colleted into a power drill. In the examples shown in FIG. 1A and FIG. 1B, stem 120 has a diameter of one-quarter inch; however, stem 120 may have any length, diameter, or configuration that is suitable for coupling the end brush 100, 105 to a desired tool.

The stem 120 is coupled to a body 140 that holds a plurality of bristles 130. In some embodiments, bristles 130 are formed from crimped or straight wire. In other embodiments, bristles 130 may be formed from stiff materials such as nylon, polypropylene, and the like. Each of the bristles 130 has a fixed end, and a free end distal to the fixed end. The fixed end of each of the bristles 130 is fastened to the body 140, such that the fixed end remains fixed in place relative to the stem 120.

The free ends of bristles 130 extend outward from the body 140, in a range of directions generally distal to stem 120. In a typical example, inner bristles 131 (i.e., bristles 130 proximate to the central axis of the stem 120) are substantially parallel to the stem 120, while the free ends of outer bristles 132 (i.e., bristles 130 distal to the central axis of the stem 120) may flare outward from the central axis of the stem 120.

In the conventional end brush 105 depicted in FIG. 1A, the bristles 130 are approximately equal to one another in length. In an exemplary end brush 100 according to an embodiment of the invention, as shown in FIG. 1B, the inner bristles 131 are approximately equal to one another in length, forming a substantially flat face portion of the end brush 100, while the outer bristles 132 are cut at an angle to the axis of the end brush 100.

Figure 2:
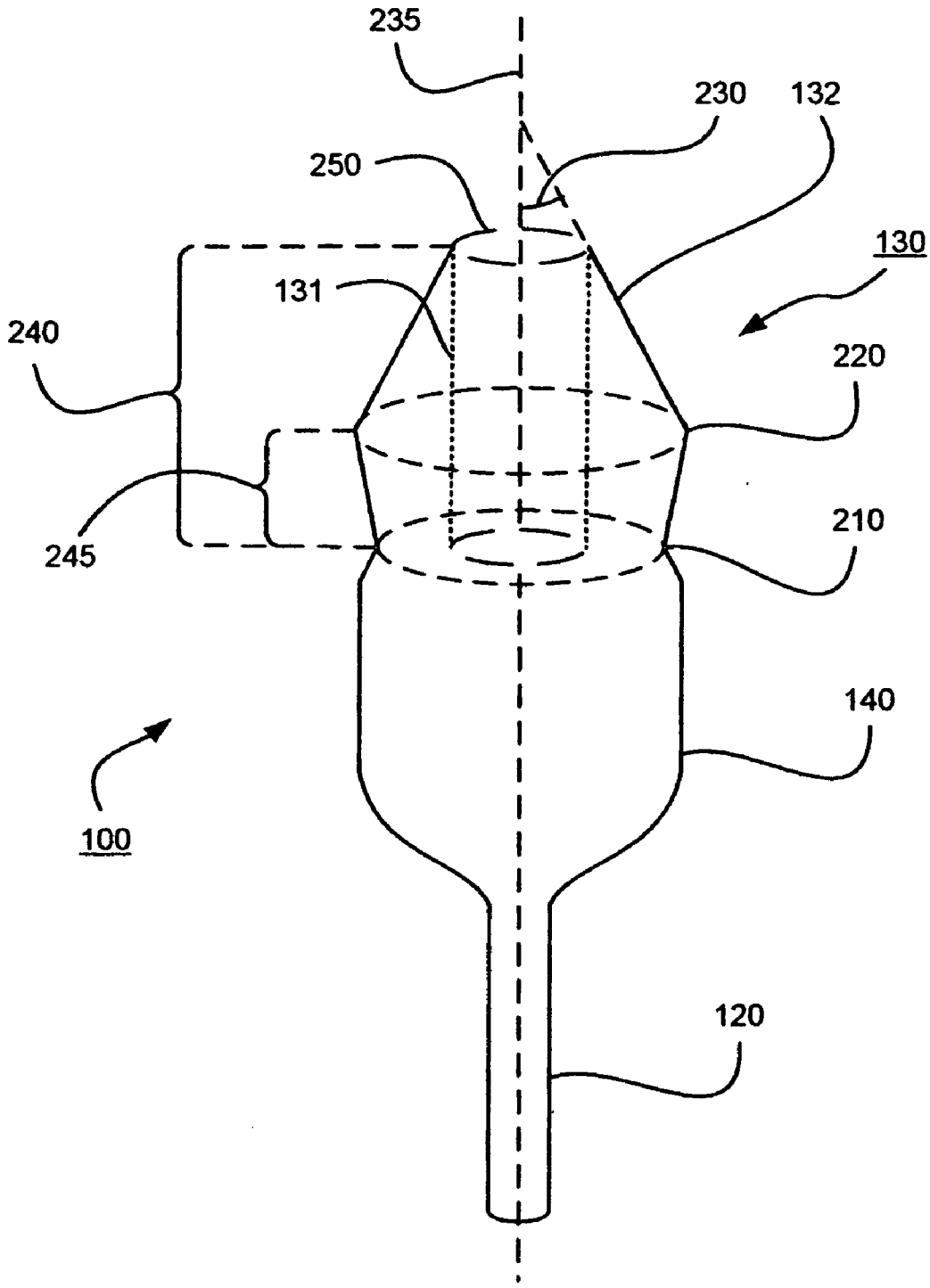
FIG. 2 is a perspective view of an exemplary end brush, in accordance with an embodiment of the invention.

FIG. 2 is a diagram depicting a perspective view of an exemplary end brush 100, in accordance with an embodiment of the invention. The end brush 100 is designed to be rotated around a rotational axis 235. The rotational axis 235 of the end brush 100 is the central axis of stem 120.

In some embodiments, the portion of the body 140 distal to the stem 120 forms a base 210 from which the free end of each of the bristles 130 emerges. In an illustrative example, the base 210 can be defined by the plane of an annulus comprising the portion of the body 140 distal to the stem 120. The length of each of the bristles 130 can be measured from the base 210 to the free end, rather than from the fixed end to the free end.

The inner bristles 131 have a substantially uniform length 240, as measured from the base 210 to the free ends of inner bristles 131. In an exemplary embodiment, inner bristles 131 may be cut substantially flat.

The free ends of inner bristles 131 form a substantially flat face portion 250 of the end brush 100. In an embodiment, the face portion 250 has a diameter between about 20% and about 75% of the diameter of the tuft of bristles 130 emerging from the base 210. In a further embodiment, the diameter of the tuft of bristles 130 emerging from the base 210 is approximately the diameter of base 210.

In an embodiment of the invention, outer bristles 132 are shorter than inner bristles 131. In the exemplary embodiment shown in FIG. 2, the outermost of the outer bristles 132, measured from the base 210 to the free ends 220, have a length 245 within a range of approximately 25% to approximately 75% of the inner bristle length 240, and the innermost of the outer bristles 132 have a length nearly equal to or slightly shorter than the inner bristle length 240.

The outer bristles 132 are shaped or cut at an angle 230 to the rotational axis 235. In an exemplary embodiment, the angle 230 is between about 40 degrees and about 45 degrees.

Figure 3:
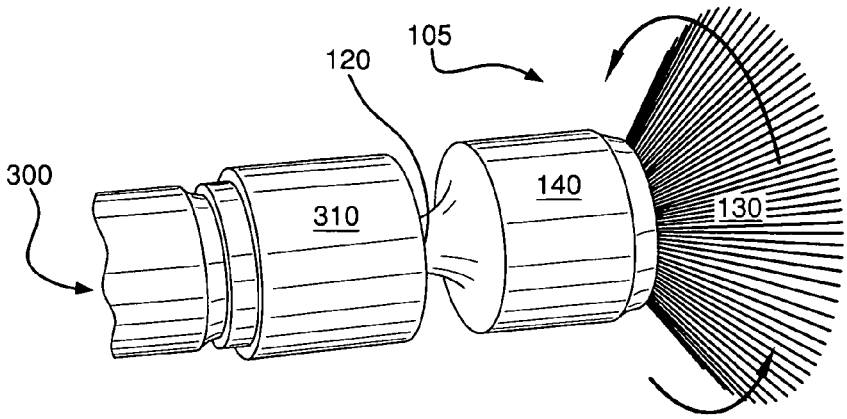
FIG. 3 (Prior Art)
FIG. 3 is a perspective view depicting flare in a conventional prior art end brush not in contact with a work piece.

FIG. 3 depicts flare in a conventional end brush 105 not in contact with a work piece. A tool 300, such as a power drill, includes a fastener 310, such as the chuck depicted in FIG. 3, that is able to receive and removably grip stem 120. The tool 300 is able to rotate the chuck 310 at high speeds, thereby imparting rotation to stem 120, body 140, and bristles 130. As shown in FIG. 3, high speed rotation causes bristles 130 to flare outward from the rotational axis 235 of the end brush 105.

Figure 4:
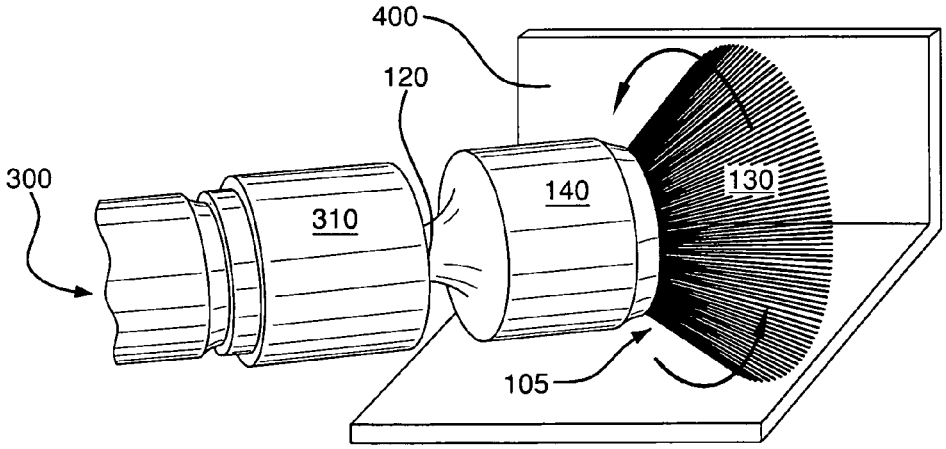
FIG. 4 (Prior Art)
FIG. 4 is a perspective view depicting flare in a conventional end prior art brush in contact with a work piece.

FIG. 4 depicts flare in a conventional end brush 105 in contact with a work piece 400. As shown in FIG. 4, high speed rotation causes bristles 130 to flare outward from the rotational axis 235 of the end brush 105. In the illustrated example, to overcome the flare and keep the free ends of bristles 130 in contact with the work piece 400, the free ends of bristles 130 may have to be pushed against the work piece 400 harder than would otherwise be necessary, or the sides of the bristles 130 may have to be pushed against the work piece 400, thereby reducing the contact area of the free ends of bristles 130 with the work piece 400.

Figure 5:
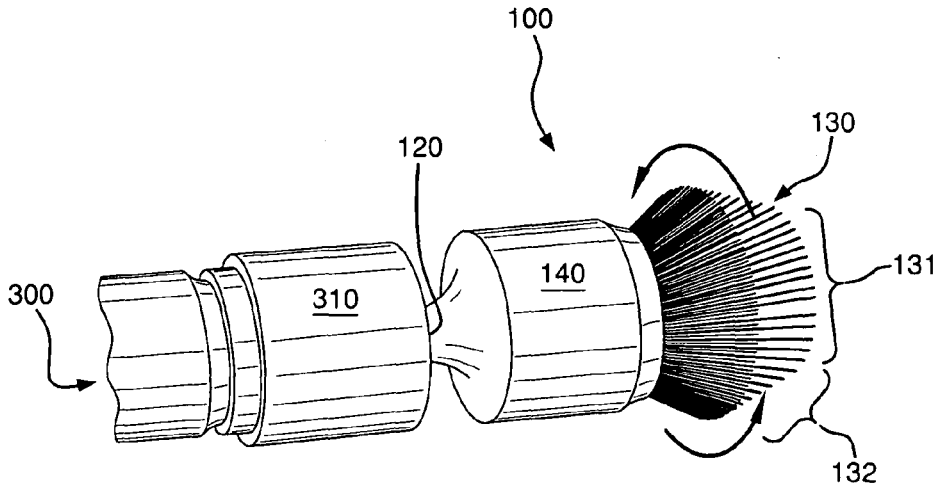
FIG. 5 is a perspective view depicting reduced flare in the exemplary end brush of FIG. 1B, when rotated at high speeds and not in contact with a work piece.

FIG. 5 depicts reduced flare in an exemplary end brush 100, in accordance with an embodiment of the invention, not in contact with a work piece 400. Tool 300 is able to rotate fastener 310 at high speeds, thereby imparting rotation to stem 120, body 140, and bristles 130. As shown in FIG. 5, the bristles 130, even during high speed rotation, are generally able to maintain the shape of the bristles 130 when static (as shown in FIG. 1B). High speed rotation of an end brush 100 according to an embodiment of the invention does not cause bristles 130 to substantially flare outward from the rotational axis 235 of the end brush 100.

Figure 6:
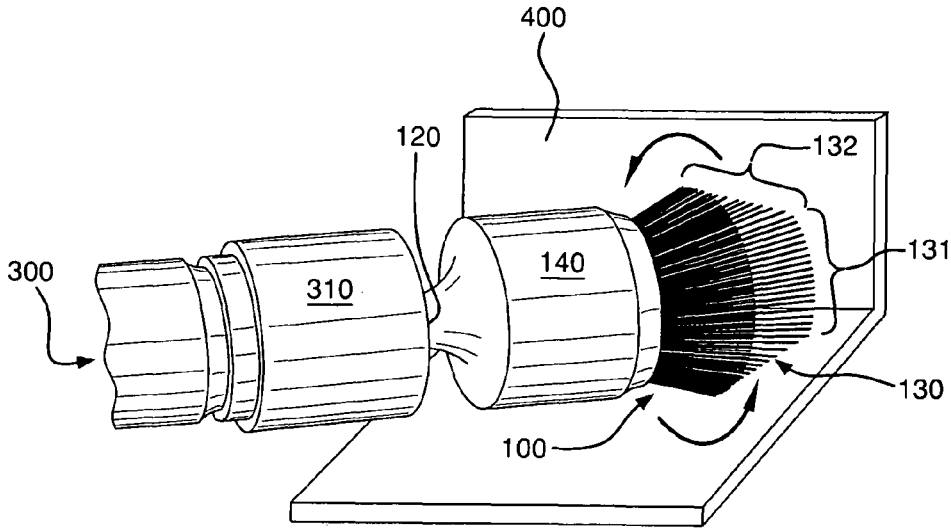
FIG. 6 is a perspective view depicting reduced flare in the exemplary end brush of FIG. 1B, when rotated at high speeds and applied in contact with a work piece.

FIG. 6 depicts reduced flare in an exemplary end brush 100, in accordance with an embodiment of the invention, in contact with a work piece 400. As shown in FIG. 6, high speed rotation of the end brush 100 does not cause bristles 130 to substantially flare outward from the rotational axis 235 of the end brush 100. In the illustrated example, little or no additional pressure against the free ends of bristles 130 is required to overcome flare and keep the free ends of bristles 130 in contact with the work piece 400. In addition, the sides of the bristles 130 generally will not need to be pushed against the work piece 400 to overcome flare. Accordingly, the contact area of the free ends of bristles 130 with the work piece 400 can be maximized.

Although exemplary implementations of the invention have been described in detail above, those skilled in the art will readily appreciate that many additional modifications are possible in the exemplary embodiments without materially departing from the novel teachings and advantages of the invention. Accordingly, these and all such modifications are intended to be included within the scope of this invention. The invention may be better defined by the following exemplary claims.

What is claimed is:

1. An end brush with reduced bristle flare, comprising:

a body having a rotational axis and a substantially planar face that is generally orthogonal to the rotational axis;

a plurality of bristles forming a tuft of bristles, each bristle fastened at a fixed end to a body and extending outward from the body in a direction generally parallel to the rotational axis of the body, each bristle having a free end distal from the body, the bristles comprising a plurality of inner bristles proximal to the rotational axis of the body and a plurality of outer bristles distal to the rotational axis, the inner bristles having a substantially uniform inner bristle length, and the free ends of the outer bristles being cut at an angle to the rotational axis such that the outermost portion of the outer bristles has a length shorter than the inner bristle length, and the innermost portion of the outer bristles has a length that is greater than the length of the outermost portion of the outer bristles and slightly shorter than the inner bristle length, the lengths of the inner bristles and the outer bristles being measured from the body to the free ends of the bristles.

2. The end brush of claim 1 wherein the inner bristles form a face portion distal to the body and substantially flat in a plane perpendicular to the rotational axis.

3. The end brush of claim 2 wherein the face portion has a diameter between about 20% and about 75% of the diameter of the tuft of bristles at the body.

4. The end brush of claim 1 wherein the outermost portion of the outer bristles has a length within a range of approximately 25% to approximately 75% of the inner bristle length.

5. The end brush of claim 1 wherein the angle at which the free ends of the outer bristles are cut are between about 40 degrees and about 45 degrees.

* * * * *